United States Patent [19]

Smith

[11] 4,337,007

[45] Jun. 29, 1982

[54] UNDERWATER EROSION CONTROL STRUCTURE

[75] Inventor: Robert A. Smith, Knaresborough, England

[73] Assignee: Imperial Chemical Industries Limited, London, England

[21] Appl. No.: 133,853

[22] Filed: Mar. 25, 1980

[30] Foreign Application Priority Data

Apr. 24, 1979 [GB] United Kingdom ..... 7914155
May 16, 1979 [GB] United Kingdom ..... 7916954

[51] Int. Cl.[3] ..... E02B 3/04
[52] U.S. Cl. ..... 405/24
[58] Field of Search ..... 405/19, 20, 21, 24, 405/25

[56] References Cited

U.S. PATENT DOCUMENTS 3,517,514 6/1970 Visser .
3,540,415 11/1970 Bromley ..... 405/24 X
3,727,411 4/1973 Rhodes .
3,745,771 7/1973 Rhodes et al. .
4,002,034 1/1977 Muhring et al. ..... 405/19
4,221,500 9/1980 Garrett ..... 405/24

FOREIGN PATENT DOCUMENTS 1802929 6/1970 Fed. Rep. of Germany .
984077 2/1965 United Kingdom ..... 405/24
1001813 8/1965 United Kingdom .
1355979 6/1974 United Kingdom .

OTHER PUBLICATIONS

Linear Composites Erosion Control Systems, Sales Brochure.

*Primary Examiner*—Carl D. Friedman
*Attorney, Agent, or Firm*—Scully, Scott, Murphy and Presser

[57] ABSTRACT

An erosion and scour control structure for laying on a sea or river bed comprising a spaced array of longer fronds of filaments with a density less than that of water and an interspersed array of shorter filaments, preferably having a density greater than that of water, both arrays being attached to base.

9 Claims, 2 Drawing Figures

UNDERWATER EROSION CONTROL STRUCTURE

This invention relates to underwater erosion and scour control structures for use in coastal areas and rivers, and around structures such as oil rigs and pipelines.

Structures for controlling erosion and scour by reducing water flow velocities near an area of sea or river bed are widely used. One such structure comprises arrays of filaments with a density greater than that of water suspended from a rigid frame above the sea bed and held down by weights resting on the sea bed. Another system comprises arrays of bundles or fronds of filaments with a density less than that of water, tied down to a base lying on the sea bed and extending upwards by buoyancy. An advantage of the buoyant structure is that it needs no rigid frame spaced above the sea bed but a disadvantage is that it is less effective in reducing water velocities near the bottom of the fronds where they are attached to a base at spaced apart points, than it is higher up the fronds where the individual filaments are more separated.

According to the present invention we provide an improved erosion and scour control structure comprising a spaced array of longer fronds of filaments with a density less than that of water and an interspersed array of shorter filaments, both arrays being attached to a base intended for laying on a sea or river bed.

The shorter filaments preferably have a density greater than that of water and in preference are of crimped polyester in which the crimps in neighbouring filaments are deregistered so that, when subjected to the action of water flow, individual filaments, which where attached to the base are in intimate contact with each other, separate from one another ie the crimps "deregister". Alternatively the shorter filaments may be crimped polyamide.

The longer buoyant fronds are preferably formed of fibrillated polypropylene tapes.

The shorter, preferably denser, filaments may be bunched into fronds and attached to spaced apart points on the base in the same way as the longer filaments or they may be attached to the base in other patterns, for instance in linear curtain-like arrays. If the shorter filaments are heavier than water then there must be sufficient of them per unit area of base so that they are prevented from collapsing on to the base and maintain an upstanding water permeable structure rather like a loose carpet pile. Crimped filaments are clearly preferably for this purpose.

The detailed design of structures according to this invention depend on particular site characteristics, such as water flow velocities to be expected and the nature of the sea bed. Typically the longer filaments may be one to two meters long, bunched into fronds of around 275 tex, and attached to the base in a square pattern about half a meter apart. Typically, the shorter filaments may be 50 to 250 cm long, and may be bunched into fronds of around 112 kilotex, and attached to the base at the vacant spaces of a square pattern with half the spacing of the longer fronds.

The base may be a rigid metal mesh, a mesh formed by weaving reinforced or unreinforced plastics strip or a flexible woven or non woven fibrous structure. To reduce water velocities below the base, it is preferable to attach a low density fibrous curtain around the periphery of the base. The curtain may take the form of a woven or non woven fabric or individual filaments of a material having a density less than one.

To prevent any scoured sand rising through the base it is preferable that a fibrous filter membrane, in the form of either a woven or non woven fabric, is attached to the underside of the base.

The present invention is illustrated by the accompanying drawings in which.

Figure 2:
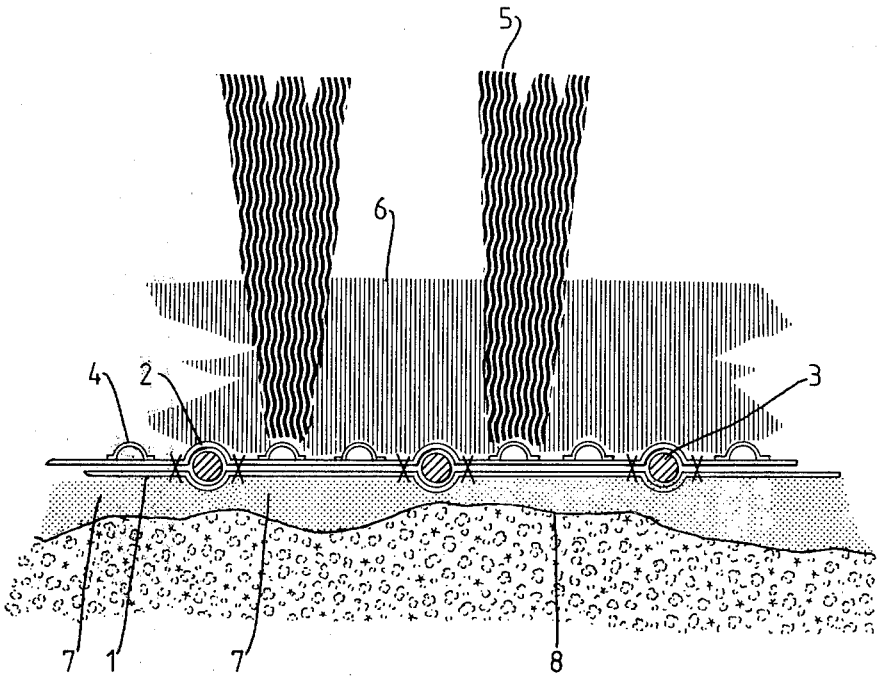
FIG. 2 is a schematic cross section of a fabric base with an attached curtain of polyester filaments and fronds of polypropylene tapes.

In FIG. 2, a base 1 comprises two sheets of woven polyester fabric sewn together to provide pockets 2 in which are inserted sinker weights 3. Tape loops 4 are sewn on to the base and fronds of polypropylene fibrillated tape 5 are attached to loops 4 at a required spacing. A curtain of crimped polyester filaments 6 comprises a section of a mat of crimped filaments made as described in British patent specificiation No. 1,001,813, the filaments being secured by stitching to a tape not shown, which is in turn stitched to the base 1. A mat of crimped polyester filaments 7, also made as described in British Patent Specification 1,001,813 is stitched to and forms a curtain below the underside of base 1. If desired the underside of the base may be covered by a woven or non-woven fabric (not shown) which serves as a filter membrane, preventing upward movement of sand through the structure. The whole structure is illustrated in position on an uneven sea bed 8.

An alternative to a woven fabric base with sinker weights is a welded steel grid with a mesh size appropriate to the required frond spacings, and attached under it a non woven fabric to act as a sand filter and to which the underlay mat may be stitched.

The base materials used in the invention may, as stated previously, be in the form of an interwoven plastics strap, a rigid metal grid or a flexible woven or non-woven fibrous structure. The selection of a suitable base material will mainly be dictated by the particular site where the structure is to be laid and the method by which the structure is to be laid.

For example, if it is proposed to lay the structure by means of a remote controlled submarine fitted with handling devices or by means of a crane both of which can lower the structure down on to the sea bed, a metal grid would be an obvious choice.

If the structure is to be laid in long lengths on either side of a submarine pipeline then the base material will require to be of high strength and also capable of being rolled-up. Such a structure can be taken down to the sea bed in a rolled-up state and then unrolled by means of tow lines attached to a boat.

If the structure is being used for repair work and consequently requires to be handled by divers, then the overall weight of the structure will be of importance. In this case the base of the structure can be a lightweight industrial fabric so providing a structure which can be rolled up and carried in a rolled-up form to the sea bed by divers where the structure can be unrolled.

The invention will now be described with reference to the following Examples.

EXAMPLES

BASE CONSTRUCTION

Six—5 meter×2 meter, 50 kg weight, mild steel rectangular mesh mats were provided having a mesh size of ¼ meter×¼ meter.

The underside of each mesh was covered with 56 kilotex crimped polyester tow, 7 meters of unstretched tow being sufficient to cover a square meter of mesh. This was achieved by spreading the tow out so that it formed a ribbon of approximately 17 cm width, attaching one end of the ribbon at one corner of the mesh, laying the ribbon across the width of the mesh adjacent one edge of the mesh, attaching the ribbon to the mesh again, laying the ribbon across the width of the mesh parallel and adjacent to the previous laid ribbon, attaching the ribbon to the mesh again and repeating the sequence of operations until the underside of the mesh is covered with the ribbon of crimped polyester.

FROND ARRAY CONSTRUCTION

Two strips of 100 kg breaking strength PARAWEB (Registered Trade Mark) were superimposed one on the other and heat welded together at intervals such that it allows insertion of polyester and/or polypropylene at ¼ meter pitch intervals.

Using the welded strips of PARAWEB two types of subassemblies, known as Type A and Type B were formed. crimped fibre secured to the welded strips at ¼ meter pitch intervals by means of, for example, cable ties. The theoretical vertical height of the fronds, measured normal to the medial plane of the welded strip was ¼ meter and the fronds had a standing dimension of 112 kilotex.

The Type B assembly consists of alternate fronds of polypropylene fibrillated tape and fronds of polyester crimped fibre secured to the welded strips at ¼ meter pitch intervals by means of, for example, cable ties. The theoretical vertical height of the polypropylene fronds, measured normal to the medial plane of the welded strip, was 1 meter and they had a standing dimension of 27,500 decitex. The theoretical vertical height of the polyester fronds, measured normal to the medial plane of the welded strip, was ¼ meter and they had a standing dimension of 112 kilotex.

ASSEMBLY OF BASE AND FROND ARRAYS

EXAMPLE 1

Strips of the Type B assembly were laid on the top side of two of the covered mesh mats parallel to the 2 meter side and secured in position with cable ties at ½ meter pitch. The strips were arranged ¼ meter apart and in such a manner that adjoining strips a polyester frond was opposite to a polypropylene frond so that the overall frond pattern was such that a polyester frond was always adjacent to a polypropylene frond.

EXAMPLE 2

Alternate strips of the Type B assembly and the Type A assembly were laid on the top side of two of the covered mesh mats parallel to the 2 meter side and secured to the mat at ½ meter pitch by means of cable ties.

Figure 1:
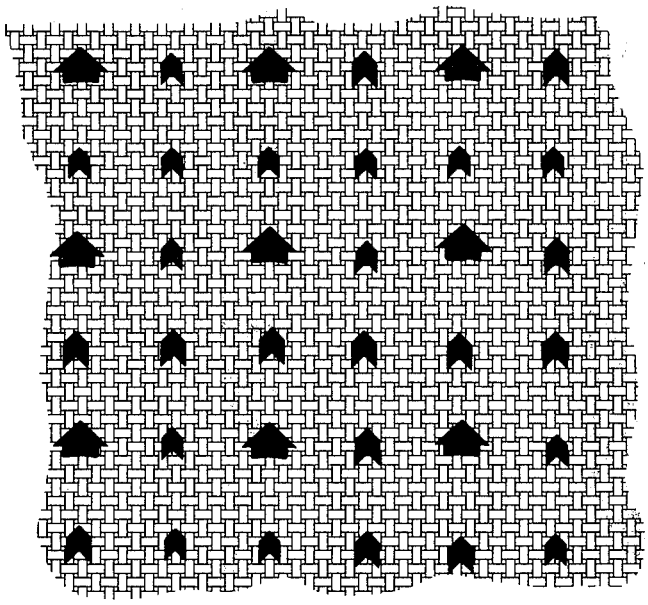
FIG. 1 is a schematic plan of a base of woven two inch wide tapes of polyester filaments coated in a polyethylenesheath. The points marked by an arrow head are the points of attachment of fronds of polypropylene fibrillated tapes and the points marked by a chevron are the points of attachment of fronds of crimped and deregistered polyester filaments.

The strips were ¼ meter apart. The relative spacing of the two types of frond assembly were as depicted in FIG. 1.

EXAMPLE 3

Parallel strips of the type B assembly were laid diagonally across the top side of two of the covered mesh mats at ¼ meter spacing. The relative positions of the two types of frond was identical to the positions in Example 1.

All of the six mats as prepared in accordance with Examples 1 to 3 were lowered down to the sea bed of the North Sea in the vicinity of a research platform by crane and manhandled into position by divers. The mats were laid to rest on the sea bed at a depth of 30 meters. The water speed was about 0.55 meter/second at that depth.

After being in position for four months, inspection by divers revealed that all of the mats had caused a significant build-up of sand so preventing erosion around the feet of the platform.

I claim:

1. An erosion and scour control structure comprising a spaced array of filaments the improvement being that the spaced array consists of an array of longer fronds of filaments with a density less than that of water and an interspersed array of shorter filaments having a density greater than that of water, both arrays being attached to a base for laying on a sea or river bed.

2. An erosion and scour control structure as claimed in claim 1 in which the shorter filaments are of crimped polyester.

3. An erosion and scour control structure as claimed in claim 1 in which the shorter filaments are bunched into fronds.

4. An erosion and scour control structure as claimed in claim 1 in which the longer fronds are formed of fibrillated polypropylene tape.

5. An erosion and scour control structure as claimed in claim 1 in which the base is a rigid metal mesh.

6. An erosion and scour control structure as claimed in claim 1 in which the base has been formed by weaving reinforced plastic strips.

7. An erosion and scour control structure as claimed in claim 1 in which the base is a flexible woven fabric.

8. An erosion and scour control structure as claimed in claim 1 in which the base has been formed by weaving unreinforced plastic strips.

9. An erosion and scour control stucture as claimed in claim 1 in which the base is a flexible non-woven fabric.

* * * * *